US005625173A

United States Patent [19]

Woods

[11] Patent Number: 5,625,173

[45] Date of Patent: Apr. 29, 1997

[54] SINGLE BAFFLE LINEAR MUFFLER FOR MARINE ENGINES

[75] Inventor: Woodrow E. Woods, Riviera Beach, Fla.

[73] Assignee: Marine Exhaust Systems, Inc.

[21] Appl. No.: 480,125

[22] Filed: Jun. 7, 1995

Related U.S. Application Data

[63] Continuation-in-part of Ser. No. 318,525, Oct. 5, 1994, Pat. No. 5,444,196, which is a continuation-in-part of Ser. No. 105,511, Aug. 11, 1993, abandoned, which is a continuation of Ser. No. 785,687, Oct. 31, 1991, Pat. No. 5,262,600.

[51] Int. Cl.[6] ..... F01N 7/08

[52] U.S. Cl. ..... 181/227; 181/235

[58] Field of Search ..... 181/235, 227, 181/228, 255, 259, 260, 264, 269, 281, 282; 440/89

[56] References Cited

U.S. PATENT DOCUMENTS

| | | | |
|---|---|---|---|
| 4,325,460 | 4/1982 | Hoppenstedt | 181/259 |
| 4,580,657 | 4/1986 | Schmeichel et al. | 181/255 |
| 4,632,216 | 12/1986 | Wagner et al. | 181/255 |
| 4,936,413 | 6/1990 | Lee | 181/264 |
| 5,123,501 | 6/1992 | Rothman et al. | 181/227 X |

*Primary Examiner*—Khanh Dang

*Attorney, Agent, or Firm*—Malin, Haley, DiMaggio & Crosby, P.A.

[57] ABSTRACT

An improved muffler for silencing the exhaust emitted from a water cooled marine engine employing a first outer housing encompassing a generally cone shaped inner member and forming a silencing volume therebetween and an angularly disposed inner planar baffle, inlet path, outlet path, ramp, and aperture for exhaust gas and cooling water to fluidly communicate from an inlet to an outlet resulting in a diminution in flow velocity so as to attenuate the exhaust noise.

4 Claims, 3 Drawing Sheets

SINGLE BAFFLE LINEAR MUFFLER FOR MARINE ENGINES

BACKGROUND OF THE INVENTION

This application is a continuation in part of application Ser. No. 08/318,525 filed Oct. 5, 1994, now U.S. Pat. No. 5,444,196, which is a continuation in part of application Ser. No. 08/105,511, filed Aug. 11, 1993, now abandoned, which is a continuation of application Ser. No. 07/785,687, filed Oct. 31, 1991, issued Nov. 16, 1993 as U.S. Pat. No. 5,262,600.

1. Field of the Invention

This invention relates generally to a muffler for quieting the exhaust from an internal combustion marine engine, and more particularly, to an in-line muffler which can replace, or be inserted into, a conventional marine exhaust system.

2. Description of the Prior Art

The exhaust of the typical inboard marine vessel is directed through the transom. Such applications place the exhaust outlet near or below the water line leading to possible back flow situations when the exhaust gas does not present enough force to overcome a water surge, or where water enters the exhaust pipe while the engine is off. To prevent this back flow of water into the muffler or engine, a check valve or flapper valve is usually employed. However, flapper valves, having moving parts, quickly corrode and fail, leading to a potentially dangerous blockage of exhaust flow.

There are a variety of marine mufflers presently known in the art which are of the "axial flow" type such as the muffler disclosed in U.S. Pat. No. 4,167,987, issued to Turner. The Turner patent describes a multiple flow marine muffler wherein exhaust noise is attenuated by passing the exhaust gas through a series of longitudinally spaced opposing baffles. Although the device allows an in-line connection, such a configuration requires an elongated cylindrical shell to provide the required baffling effect, thus precluding application in tight-fit areas such as smaller boats or other situations where space is at a premium. Additionally, the axial flow muffler disclosed does not address the need to counter water surges. Also, axial flow mufflers cannot be placed below the water line without some form of surge suppression.

Another marine muffler, known as a "lift muffler," is disclosed in U.S. Pat. No. 3,296,997, issued to Hoiby, et al. The Hoiby muffler is essentially an up-right drum-shaped housing having an exhaust inlet near the top and a stand pipe exhaust outlet centrally located with its opening spaced above the drum bottom. The stand pipe directs the muffled exhaust gas and collected cooling water upwardly and outwardly to a location where it can be discharged from the boat without further back pressure. However, such a device precludes application in tight-fit areas as the centrally located stand pipe requires exhaust conduit modifications to accommodate the pipe. Further, Hoiby does not present a means to prevent a reverse flow of water when the exhaust outlet is submerged.

Another type of marine muffler is disclosed in U.S. Pat. No. 4,917,640, issued to Miles. Miles teaches the use of a marine muffler wherein the engine exhaust is displaced between chambers through a series of parallel conduits transverse to the muffler body length. Cooling water from the exhaust manifold is entrapped at the bottom of the main chamber, a portion thereof remaining in the chamber, the remainder of which accompanies exhaust gas out of the muffler body. The exhaust noise is attenuated by baffling the exhaust gas through multiple chambers and by contact with the entrapped water. However, this type of muffler is not amenable to mounting within the boat hull without elaborate piping geometry so that the muffler can be fed at the top and evacuated at the bottom.

The exhaust outlet of an inboard-powered marine vessel is usually placed at or about the water line of the boat. As a result, surges of water routinely enter the exhaust outlet and travel through the exhaust system. This surge water could disable the engine if it is permitted to travel far enough, possibly leading to disastrous results, especially if the vessel is far from port.

Also, in certain applications, it is very difficult and/or costly to remove and replace a marine muffler, in some cases requiring the destructive removal of the rear deck, replacement of the muffler therebelow, and subsequent installation of new decking. No one has heretofore proposed a single baffle anti-surge in-line muffler which may be inserted into the exhaust system of an inboard marine vessel through the external exhaust opening.

Therefore, there exists a need for a muffler capable of installation within the confines of a conventional exhaust pipe wherein the exhaust inlet and outlet may be situated at the same level to permit in-line placement thereof. Further, there exists a need to prevent back flow of water into the muffler without the addition of a check or flapper valve.

SUMMARY OF THE INVENTION

The present invention provides an in-line muffler for use with internal combustion marine engines. The apparatus is characterized by a generally cone shaped inner member made from steel or heat resistant fiberglass, defining in part a planar baffle which, when inserted into a conventional exhaust pipe, define an input path and an output path which are designed to attenuate engine exhaust noise and further operate as a surge protector. Alternatively, the inner member can be placed within a larger housing and permanently attached thereto, forming a muffler assembly wherein the larger housing includes an inlet and an outlet adaptable to conventional exhaust system connections such as flanges, U-bolts, welding, or the like.

The inner member defines both an inner and an outer peripheral surface which in conjunction with the outer housing, define an inlet silencing volume and an outlet path and is sealingly attachable to the inner surface of the outer housing, or exhaust conduit. The inner and outer peripheral surfaces of the inner member further define at least one aperture that permits fluid communication between the inlet silencing volume and the outlet path. The conically shaped inner member also defines an impervious planar baffle that terminates in an outer periphery and is angled with respect to radial planes passing normal to the elongate center axis of the outer housing or exhaust conduit.

At a first, upstream, inlet end the inner and outer peripheral surfaces of the inner member converge into a narrow region that is formed into a ramp that is attached to the inner surface of the outer housing or exhaust conduit. The ramp prevents surge water passing through the aperture from surging through the exhaust system into the engine. At a second, downstream, outlet end the inner member is flared outwardly and attached to the inner surface of the outer housing or exhaust conduit.

The muffler is made operational through the shape of the inlet silencing volume and outlet path that both baffle and direct the influx of exhaust gas and cooling water from an inlet through the aperture to the outlet in a manner that attenuates exhaust noise. In the preferred embodiment, exhaust gas is forced into the inlet path against the planar baffle and is circulated and redirected within the silencing volume formed between the outer peripheral surface of the inner member and the inner surface of the outer housing and is forced through an aperture located in the bottom part of the inner member. Thereafter the exhaust gas and water exit through the outlet path and segment and continue into a conventional exhaust pipe coupled thereto.

Additionally, the angularly disposed planar baffle in conjunction with a ramp act as a reversing means to reverse the flow of surge water entering into the muffler, thereby preventing surge water from reaching the engine. The ramp is either integrally formed as part of the inner member or it is a separate piece. In either embodiment, the ramp serves both as a means for connecting the inner member to the outer housing and as a means for preventing the reverse flow of surge water passing through the aperture.

In accordance with the present invention, it is an object to provide an improved in-line muffler for use with marine engines which permits installation within a minimal space in the boat hull.

It is an additional object of the instant invention to provide an improved in-line muffler which permits collinear placement of the inlet and outlet exhaust passageways, thus allowing lower placement of the exhaust outlet relative to the water line without additional piping or back pressure.

It is still another object of the instant invention to provide an in-line, anti-surge marine muffler.

It is yet still another object of the instant invention to provide a break in the exhaust flow path of an in-line muffler, effectively operating as a surge protector.

Still another object of the instant invention is to provide a baffle integrally formed in a inner member which can be inserted into a tubular housing.

Still another object of the instant invention is to provide a low cost replacement muffler that can be used with conventional or existing exhaust pipe.

In accordance with these and other objects which will become apparent hereinafter, the instant invention will now be described with particular reference to the accompanying drawings.

DETAILED DESCRIPTION OF THE PREFERRED EMBODIMENT

Figure 1:
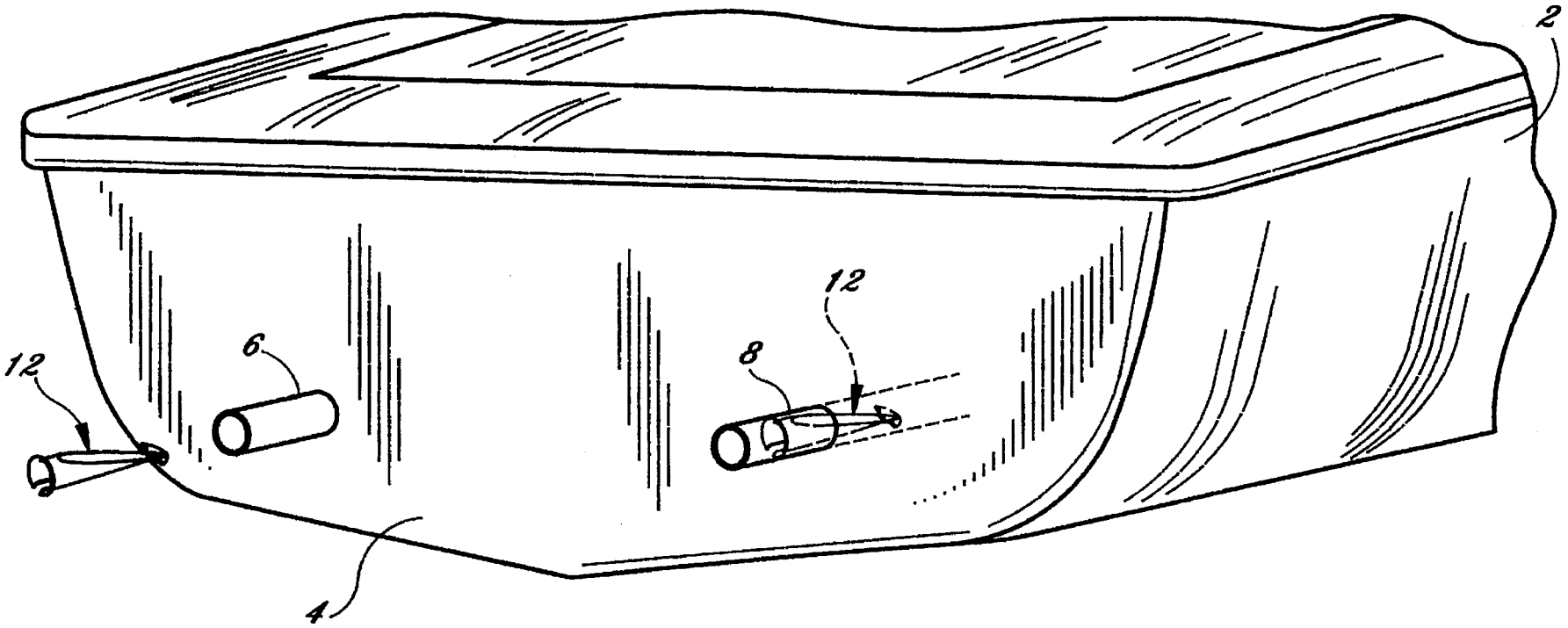
FIG. 1 is a perspective view of a boat transom illustrating placement of the instant invention.

FIG. 1 illustrates a boat 2 having a transom stern wall 4 with exhaust pipes 6 and 8 protruding through the stern wall 4. The insertion muffler 12 of the instant invention is shown positioned within exhaust pipe 8 and readied for placement within exhaust pipe 6.

Figure 2A:
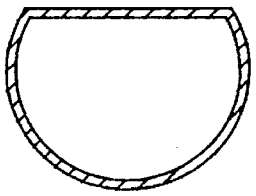
FIG. 2*a* is a partial cross sectional view of the embodiment shown in FIG. 2.
Figure 2:
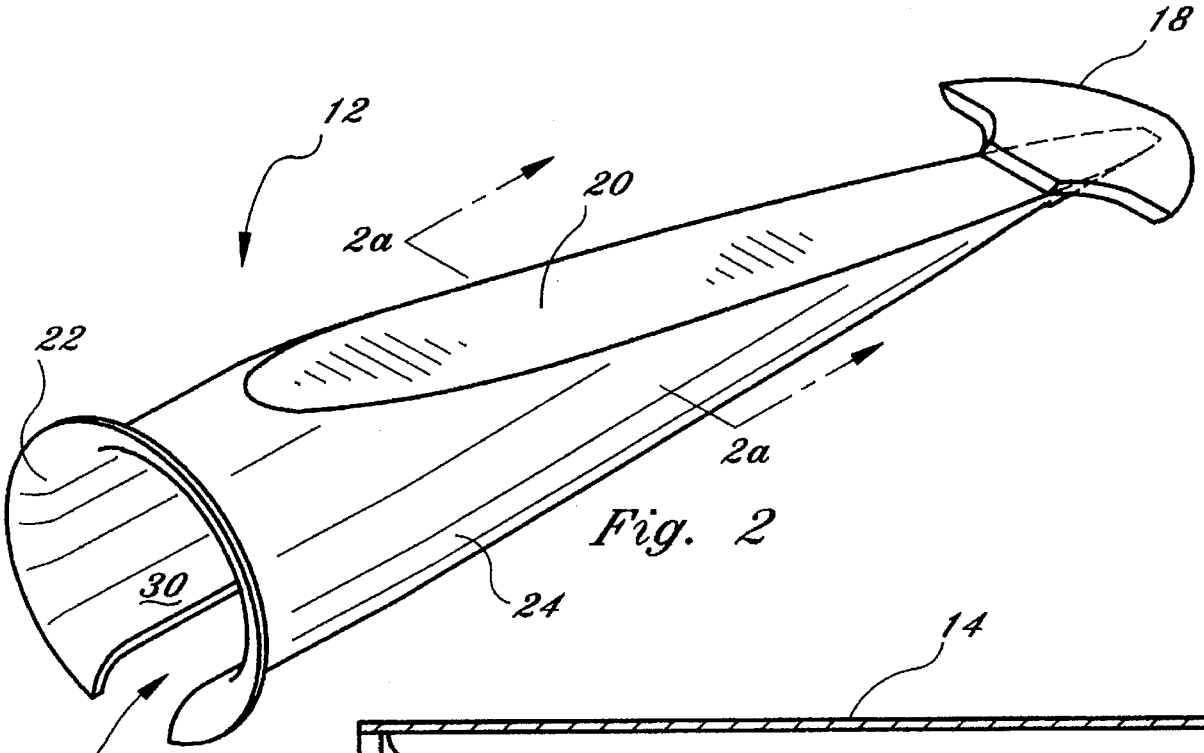
FIG. 2 is a perspective view of the insertion assembly of the instant invention.
Figure 3:
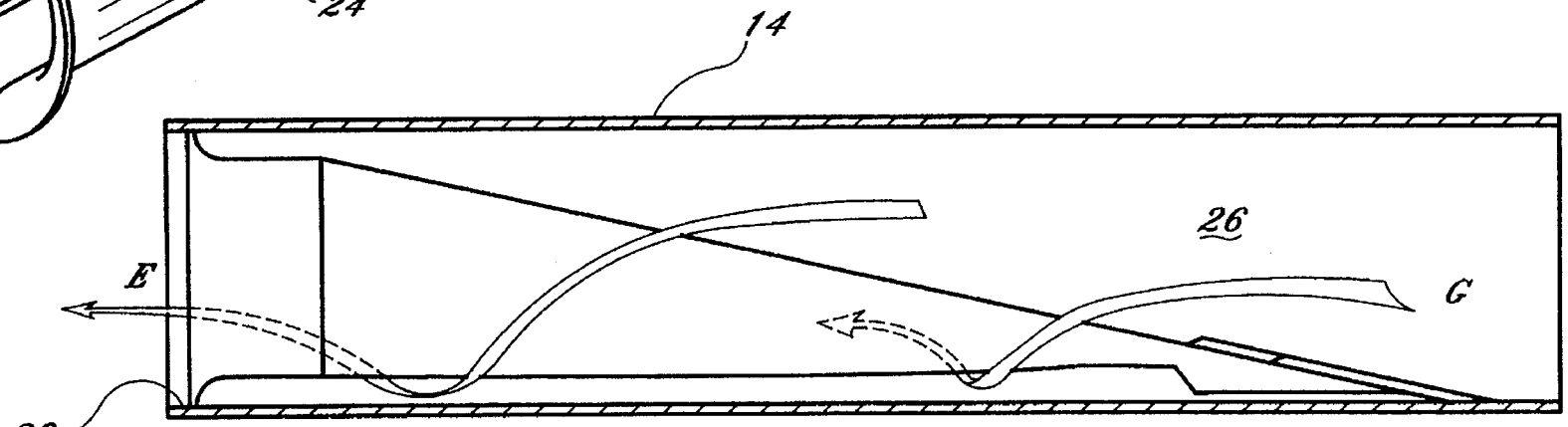
FIG. 3 is a sectional view of the inner member within an outer housing.

With reference to FIGS. 1–3, there is depicted an inner member 12 and outer housing 14 of the improved in-line muffler apparatus. Inner member 12 and outer housing 14 may be fabricated from, for example but not by way of limitation, steel or fire retardant fiberglass. Inner member 12 is generally conical in shape and defines an aperture 16, ramp 18, and baffle 20.

Inner member 12 further comprises both inner and outer peripheral surface 22 and 24 which in conjunction with the outer housing 14, define an inlet silencing volume 26 and an outlet path and is sealingly bonded to the inner surface 28 of outer housing 14, or exhaust conduit. The inner and outer peripheral surfaces 22 and 24 respectively further define aperture 16 that permits fluid communication between the inlet silencing volume 26 and outlet path 30. At a first, upstream, inlet end of inner member 14 the inner and outer peripheral surfaces converge into a narrow region that is formed into a ramp 18 which is attached to the inner surface 28 of outer housing 14. At a second, downstream, outlet end inner member 14 is flared outwardly and attached to inner surface 28 of outer housing 14 or exhaust conduit.

The impervious planar baffle 20 defined by inner member 12 terminates in an outer periphery and is angled with respect to radial planes passing normal to the elongate center axis of outer housing 14. Preferably, baffle 20 is disposed at an angle between 5 and 85 degrees with respect to radial planes passing normal to the elongate central axis of the outer housing. In an alternate embodiment, baffle 20 is an impervious planar member constructed of material compatible with the inner member and is attached to outer surface 24 by bonding, welding, or the like, preferably at an angle between 5 and 85 degrees.

The angularly disposed planar baffle 20 in conjunction with ramp 18 act as a reversing means to reverse the flow of surge water into the muffler, thereby preventing surge water from reaching the engine. Ramp 18 is either integrally formed as part of inner member 12 or it is a separate piece. In either embodiment, ramp 18 serves both as a means for connecting inner member 12 to outer housing 14 and a means for preventing the reverse flow of surge water into the muffler.

The inner and outer peripheral surfaces 22 and 24 of inner member 12 further define at least one elongated aperture 16 within the side wall of said inner member to fluidly communicate the silencing volume 26 with the outlet path 30. In the preferred embodiment, a single aperture 16 is located in the lower portion of inner member 12. However, it is realized that a plurality of apertures may be employed in an alternate embodiment.

Figures 4, 4A, 5, 5A:
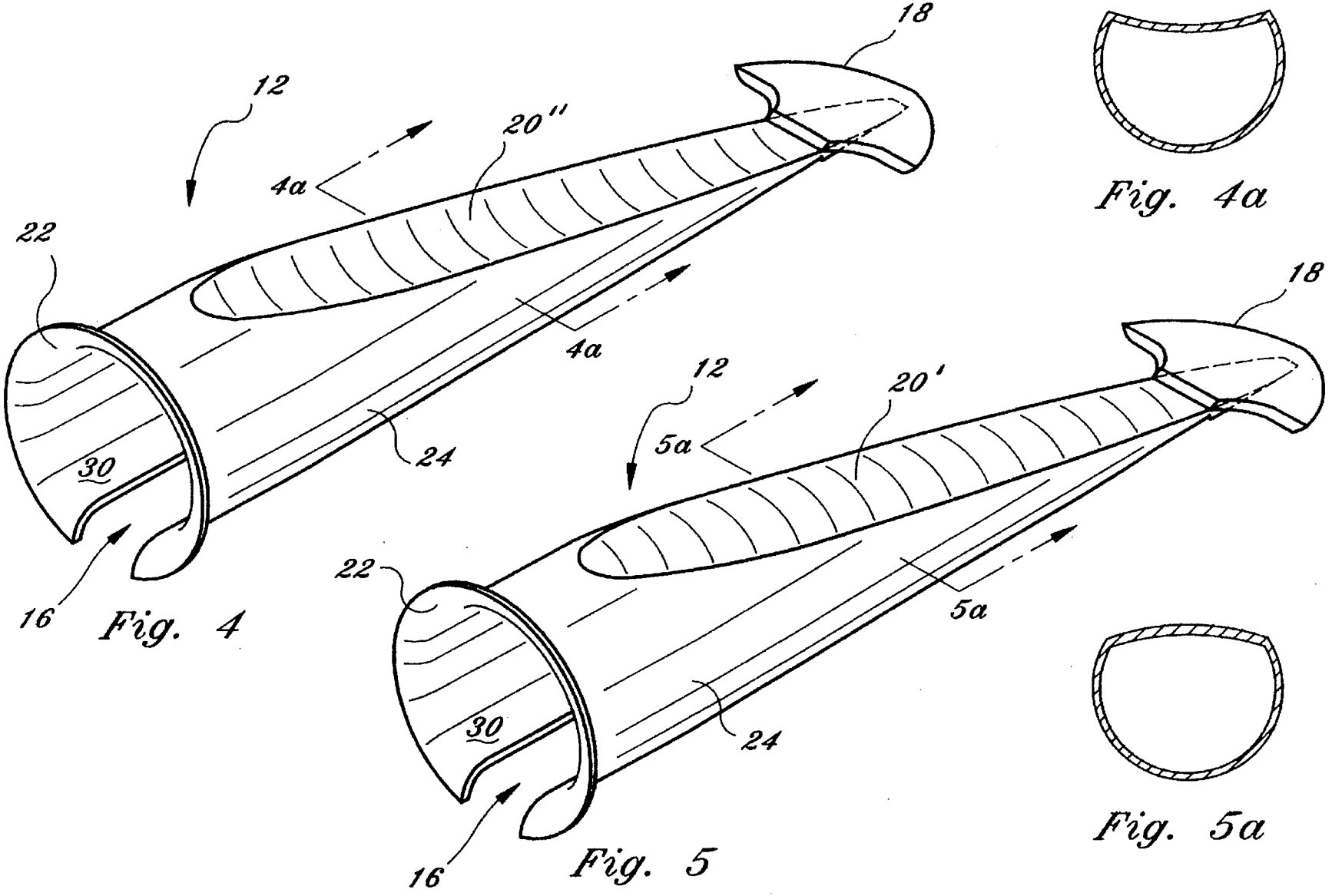
FIG. 4 is a perspective view of an alternate embodiment of the insertion assembly of the instant invention having a concave baffle outer surface.
FIG. 4*a* is a partial cross sectional view of the alternate embodiment shown in FIG. 4.
FIG. 5 is a perspective view of an alternate embodiment of the insertion assembly of the instant invention having a convex baffle outer surface.
FIG. 5*a* is a partial cross sectional view of the alternate embodiment shown in FIG. 5.

It should be noted throughout this disclosure that baffle 20 may be planar as best depicted in FIGS. 2 and 2*a*, and generally referenced as 20, convex, as best depicted in FIGS. 5 and 5*a*, and generally referenced as 20', concave, as best depicted in FIGS. 4 and 4*a*, and generally referenced as 20", or any other configuration, so long as surge water is redirected and further so long as the outlet path is sealed off from the silencing volume excepting the aperture 16 defined by the inner member.

The muffler is made operational through the shape of the inlet silencing volume and outlet path that both baffle and direct the influx of exhaust gas and cooling water from an inlet through aperture 16 to an outlet in a manner that attenuates exhaust noise. In the preferred embodiment, exhaust gas is forced into the inlet path against planar baffle 20 and around the outer peripheral surface 24 of inner member 12 and through aperture 16 at the bottom of the inner member. Thereafter the exhaust gas and water exit through the outlet path and segment and continue into a conventional exhaust pipe coupled thereto.

Now referring to FIG. 3, a muffler assembly is depicted wherein an elongated tubular outer housing 14 is shown having side wall of nominal thickness and an inner surface 28. As mentioned earlier, the housing 14 can be a separate housing, or alternatively, it is part of the existing exhaust conduit. When the housing is an existing exhaust conduit as shown, inner member 12 is shown slidably inserted into outer housing 14 wherein ramp 18 and flared end are bonded to inner surface 28. The peripheral or silencing volume 26 is formed between the outer peripheral surface 24 of inner member 12 and the inner surface 28 of outer housing 14.

FIG. 3 also illustrates operation of the muffler for silencing of exhaust gas by directing high velocity exhaust gas, and cooling water injected and mixed therewith, collectively referred to as G, into the silencing volume. As the exhaust gas and cooling water mixture enters the silencing volume the exhaust will reflect off planar baffle 20 forcing the exhaust around outer peripheral surface 24 and through aperture 16. Cooling water that condenses will accumulate along the bottom of silencing volume 26 which aids in heat transfer and noise dissipation. The energy of the escaping exhaust gas through aperture or passageway 16 will force a portion of the condensed volume of cooling water to vaporize or otherwise be transported upwards and through the aperture where the gas and water may exit through outlet path 30 in the form of exhaust gas flow E.

The angularly disposed planar baffle 20 functions as an acoustical barrier by creating sonic reflections within silencing volume 26 which assists in dissipation of the acoustical energy of the exhaust, and serves as a surge protector by impeding the reverse flow of water into the engine exhaust manifold by functioning as a ramping surface or break between the silencing volume 26 and output path 30, respectively. Accordingly, less external exhaust piping is required, resulting in lower overall exhaust system back pressure and, thus, higher engine efficiency.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An inline muffler for use in a marine exhaust system, comprising:

an elongate member, said member having a first upstream end, a second downstream end, and a side wall connecting said ends, said side wall having an inner peripheral surface and an outer peripheral surface, said inner and outer peripheral surfaces converging at said first upstream end and diverging at said second downstream end, said outer peripheral surface having a planar portion functioning as a baffle between said first upstream and said second downstream ends for reflecting acoustical waves from said outer peripheral surface thereby dissipating acoustical energy and for impeding reverse water flow by forming an inner peripheral surface barrier, said member side wall further defining a slotted aperture originating at said second downstream end and extending longitudinally toward said first upstream end; and a ramp attached to said member first upstream end, said ramp having a pair of laterally extending flanges.

2. An in-line muffler for a marine engine, said muffler comprising:

a elongate inner member, said member having a first upstream end, a second downstream ends, and a side wall connecting said ends, said side wall having an inner peripheral surface and an outer peripheral surface, said side wall converging at said first upstream end and diverging at said second downstream end and said second downstream end terminating in a flared end portion, said outer peripheral surface having a planar portion functioning as a baffle between said first upstream and said second downstream ends for reflecting acoustical waves from said outer peripheral surface thereby dissipating acoustical energy and for impeding reverse water flow by forming an inner peripheral surface barrier, said side wall defining a slotted aperture originating at said second downstream end and disposed diametrically opposite said planar portion;

a ramp, said ramp attached to said outer peripheral surface proximal to said second downstream end, said ramp having a pair of laterally extending flanges; and an elongate outer housing, said housing defining a second inner peripheral surface, said member outer peripheral surface bonded to said second inner peripheral surface at the flared portion of said first upstream end and at said ramp;

wherein, in use, exhaust gas and cooling water enters a volume formed between said elongate inner member outer surface and said outer housing inner surface and is directed against said outer peripheral surface planar portion wherein said outer peripheral surface redirects said exhaust gas and cooling water between said outer peripheral surface and said second inner peripheral surface until said exhaust gas and cooling water reach said aperture whereby said gas and water pass therethrough and are directed by said inner peripheral surface and exit said muffler.

3. An in-line muffler for insertion in an exhaust conduit of a marine engine, said muffler comprising:

a elongate inner member, said member having a first upstream end, a second downstream end, and a side wall connecting said ends, said side wall having an inner peripheral surface and an outer peripheral surface, said side wall surfaces converging at said first upstream end and diverging at said second downstream end, said second downstream end terminating in a flared end portion, said outer peripheral surface having a concave portion functioning as a baffle between said first upstream end and said second downstream end for reflecting acoustical waves from said outer peripheral surface thereby dissipating acoustical energy and for impeding reverse water flow by forming an inner peripheral surface barrier, said side wall defining a slotted aperture originating at said second downstream end and disposed diametrically opposite said concave portion;

a ramp, said ramp attached to said outer peripheral surface proximal to said second downstream end, said ramp having a pair of laterally extending flanges; and an elongate outer housing, said housing defining a second inner peripheral surface disposed radially about, and spaced from, said member outer peripheral surface, said member outer peripheral surface bonded to said second inner peripheral surface at said flared end portion of said first upstream end and at said ramp;

wherein, in use, exhaust gas and cooling water enters a volume formed between said elongate inner member outer surface and said outer housing inner surface and is directed against said outer peripheral surface concave portion wherein said outer peripheral surface redirects said exhaust gas and cooling water between said outer peripheral surface and said second inner peripheral surface until said exhaust gas and cooling water reach said aperture whereby said gas and water pass therethrough and are directed by said inner peripheral surface and exit said muffler.

4. An in-line muffler for insertion in an exhaust conduit of a marine engine, said muffler comprising:

a elongate inner member, said member having a first upstream end, a second downstream end, and a side wall connecting said ends, said side wall having an inner peripheral surface and an outer peripheral surface, said side wall surfaces converging at said first upstream end and diverging at said second downstream end, said second downstream end terminating in a flared end portion, said outer peripheral surface having a convex portion functioning as a baffle between said first upstream end and said second downstream end for reflecting acoustical waves from said outer peripheral surface thereby dissipating acoustical energy and for impeding reverse water flow by forming an inner peripheral surface barrier, said side wall defining a slotted aperture originating at said second downstream end and disposed diametrically opposite said convex portion;

a ramp, said ramp attached to said outer peripheral surface proximal to said second downstream end, said ramp having a pair of laterally extending flanges; and an elongate outer housing, said housing defining a second inner peripheral surface disposed radially about, and spaced from, said member outer peripheral surface, said member outer peripheral surface bonded to said second inner peripheral surface at said flared end portion of said first upstream end and at said ramp;

wherein, in use, exhaust gas and cooling water enters a volume formed between said elongate inner member outer surface and said outer housing inner surface and is directed against said outer peripheral surface convex portion wherein said outer peripheral surface redirects said exhaust gas and cooling water between said outer peripheral surface and said second inner peripheral surface until said exhaust gas and cooling water reach said aperture whereby said gas and water pass therethrough and are directed by said inner peripheral surface and exit said muffler.

* * * * *